United States Patent [19]

Griswold

[11] 4,231,170

[45] Nov. 4, 1980

[54] INSTEP PROTECTOR FOR SAFETY SHOES

[76] Inventor: Frank B. Griswold, R.F.D. 4, Bethlehem, Pa. 18015

[21] Appl. No.: 8,975

[22] Filed: Feb. 2, 1979

[51] Int. Cl.[2] ..... A43C 13/14

[52] U.S. Cl. ..... 36/72 R; 36/77 R

[58] Field of Search ..... 36/72 R, 77 R, 77

[56] References Cited

U.S. PATENT DOCUMENTS

| | | | |
|---|---|---|---|
| Re. 22,614 | 3/1945 | Roberts | 36/72 R |
| D. 157,124 | 2/1950 | Boughey | 36/72 R X |
| 1,640,669 | 8/1927 | Sankey | 36/72 R |
| 1,867,036 | 7/1932 | Strauss | 36/72 R |
| 2,392,867 | 1/1946 | Stoner et al. | 36/72 R |
| 2,555,900 | 6/1951 | Roberts | 36/72 R |
| 3,102,347 | 9/1963 | Griswold et al. | 36/72 R |
| 3,271,888 | 9/1966 | Graham et al. | 36/72 R |
| 3,481,055 | 12/1969 | Herman | 36/72 R |

FOREIGN PATENT DOCUMENTS

| | | | |
|---|---|---|---|
| 2027661 | 12/1971 | Fed. Rep. of Germany | 36/72 R |
| 892180 | 1/1944 | France | 36/72 R |
| 994443 | 8/1951 | France | 36/72 R |

*Primary Examiner*—James Kee Chi

*Attorney, Agent, or Firm*—Shanley, O'Neil and Baker

[57] ABSTRACT

A safety shoe instep guard of compound curvature conforming generally to the shape of the human instep is constructed as an integral part of the shoe or secured to the shoe adjacent at least the lower end of the guard and extends upwardly from the region of the toes. The guard includes a plurality of elongated generally arched-shaped rigid strips extending transversely of the instep and are articulated together in overlapping relation to provide an armored protector assembly having sufficient flexibility to permit normal use and movement of the shoe. The articulated rigid strips are provided with an upwardly directed, generally arcuate arch extending transversely of the individual strips, with the arcuate arches of adjacent rigid strips overlapping and cooperating to form a continuous upwardly directed reinforcing ridge extending substantially the full length of the articulated armor assembly. A strip of increased dimension and strength is provided near the bottom of the articulated armor assembly to provide increased protection at the lower end of the guard.

10 Claims, 13 Drawing Figures

FIG. 1
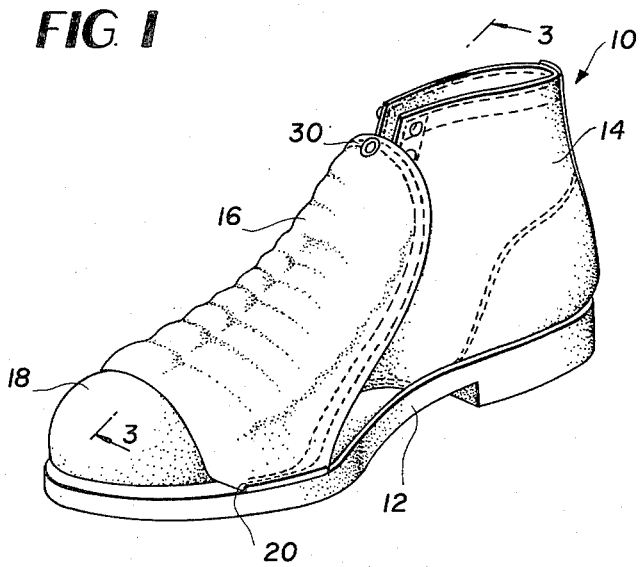
FIG. 2
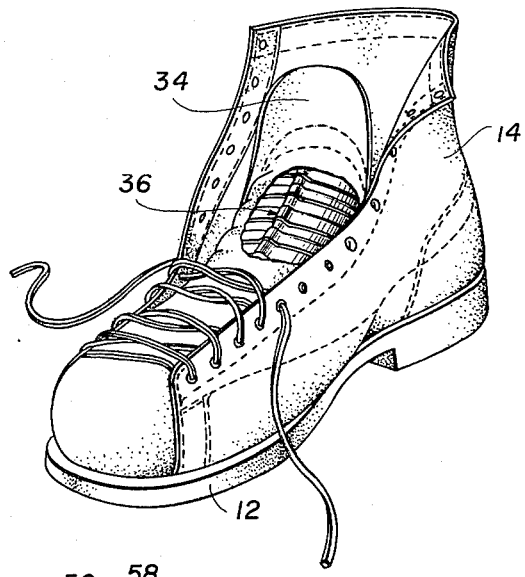
FIG. 3
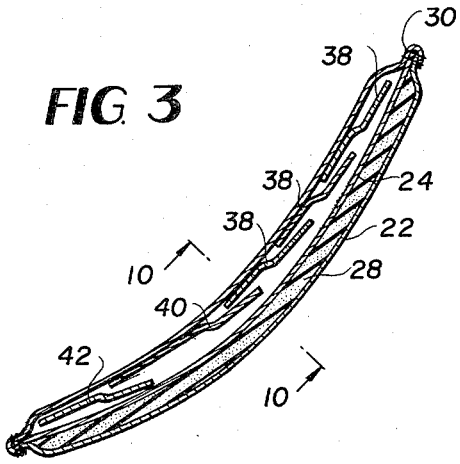
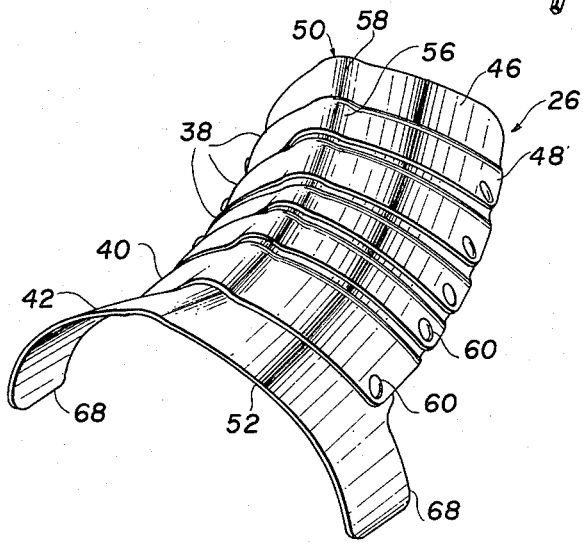
FIG. 4

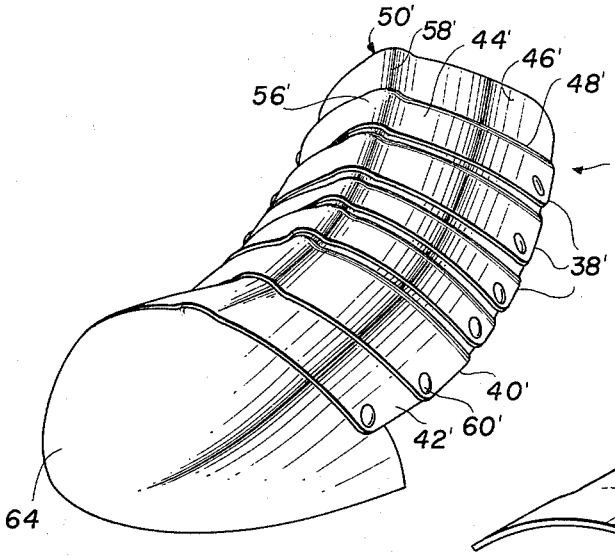
FIG. 5
FIG. 6
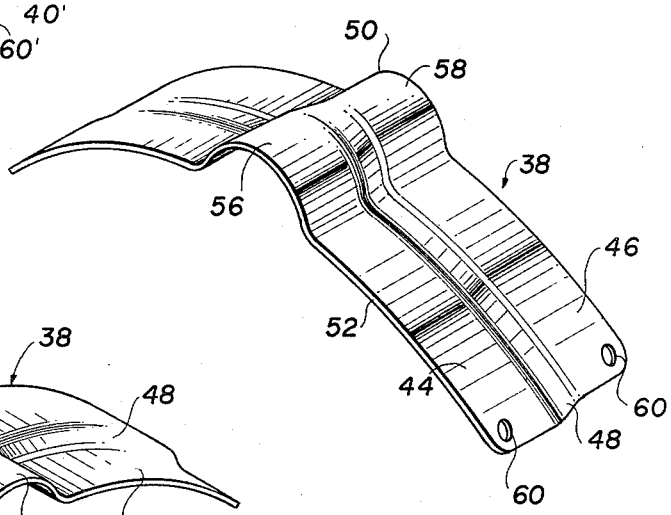
FIG. 7
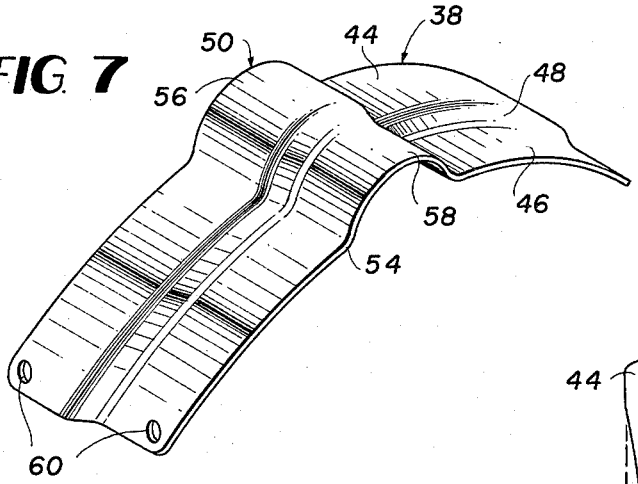
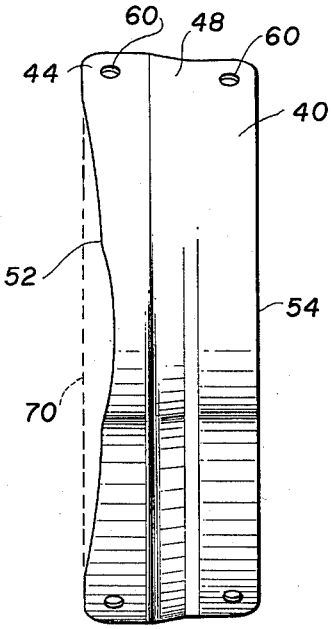
FIG. 8

FIG. 9
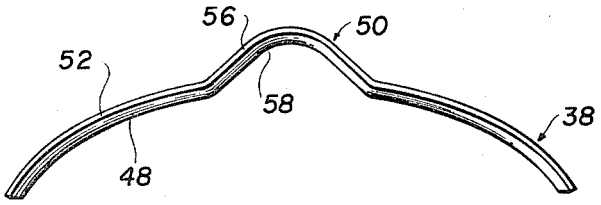
FIG. 10
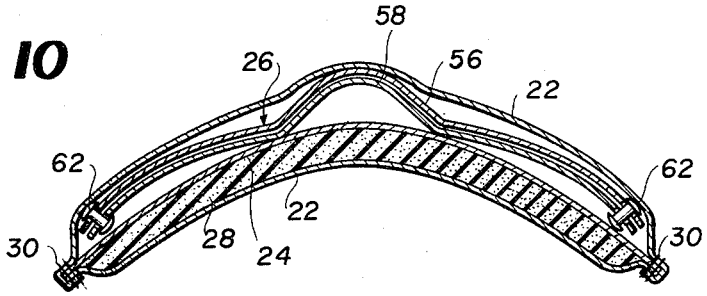
FIG. 11
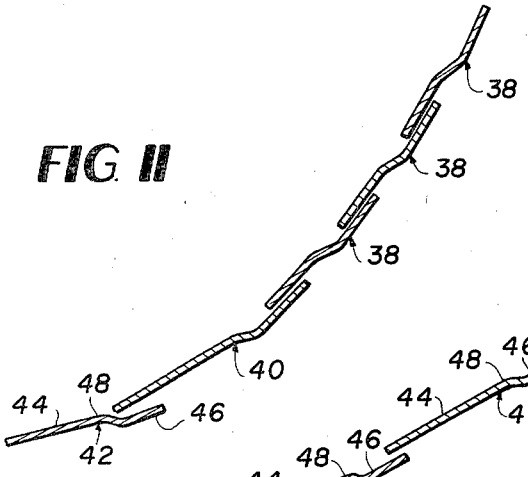
FIG. 12
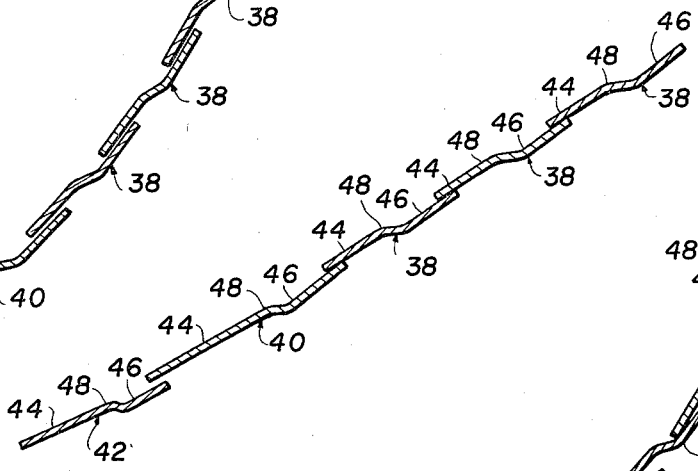
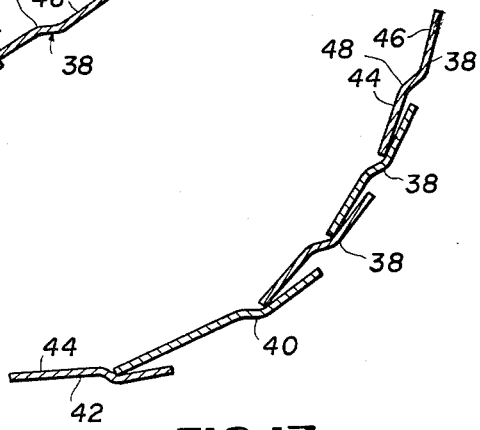
FIG. 13

INSTEP PROTECTOR FOR SAFETY SHOES

BACKGROUND OF THE INVENTION

1. Field of the Invention

This invention relates to safety shoes incorporating instep guards and to instep guards for such safety shoes, and more particularly to such safety shoes and instep guards incorporating an improved articulated reinforcing assembly.

2. Description of the Prior Art

The most common safety shoe used in industry is constructed with a steel toe cap built into the shoe. Such shoes have proven effective in protecting the feet of the wearer against certain types of injuries, and the wearing of such shoes is recommended or required in many industries. However, toe cap safety shoes offer only minimal protection for the wearer's foot against injuries by blows to the metatarsal arch, or instep, region of the foot.

Instep guards are known which embody a rigid member, or members, shaped to generally conform to the contour of the instep. These known instep guards may either be permanently attached to or form an integral part of a safety shoe incorporating the conventional toe cap, or be constructed as separate items for wear over the top of shoes such as street shoes, conventional work shoes, or safety toe shoes.

One prior art safety shoe and instep guard, disclosed in Griswold, et al., U.S. Pat. No. 3,102,347, incorporates in the instep guard an articulated reinforcing assembly which conforms generally to the countour of the instep and which is sufficiently flexible to permit freedom of movement by a person wearing the shoes during activity. The articulated reinforcing assembly possesses sufficient rigidity and strength to offer substantial protection from injuries to the instep resulting from a blow as by a falling object.

Instep guards embodying a single rigid member are conventionally of the type attached to and worn over a shoe, one such device being illustrated, for example, in U.S. Pat. No. 3,271,888. Such devices are not entirely satisfactory both because they are uncomfortable to wear and tend to limit the freedom of movement of the wearer and because they are generally quite heavy so that wearing them causes fatigue. Further, they are difficult to attach to a shoe in a manner to assure their retention during use.

Another known foot protector, illustrated in U.S. Pat. No. 2,555,900, employs a rigid toe cap which fits onto the end of a wearer's shoe, and an instep protector consisting of a main instep cover pivoted onto the cap and an auxiliary, removeable cover hinged to the main cover. The auxiliary cover extends upwardly along the upper instep and lower tibia regions. The main instep cover is reinforced by a plurality of upwardly projecting longitudinal, laterally spaced corregations or ribs extending along its top. The foot protector assembly of this prior patent is substantially larger than the shoe over which it is intended to fit, and is retained in spaced relation to the outer surface of the shoe by spring-pressed shoe contact members. The protector devices, are, therefore, awkward to use and as a result have themselves presented certain hazards.

While the drawbacks of the prior art devices such as those illustrated by the above mentioned U.S. Pat. Nos. 2,555,900 and 3,271,888 are largely overcome by the safety shoe incorporating the articulated instep protector of the above mentioned U.S. Pat. No. 3,102,347, such articulated instep protectors have not always possessed the strength and rigidity required by certain heavy industries such as the steel industry, and it is therefore the primary object of the present invention to provide an improved, strengthened, articulated instep protector incorporated in or useful in connection with a safety shoe.

A more specific object of the present invention is to provide an improved safety shoe and instep guard therefor which is of the general type illustrated in the above mentioned U.S. Pat. No. 3,102,347 but which provides greater protection for the instep.

Another object is to provide an improved articulated instep guard including a plurality of rigid protective strips articulated together and each having an upwardly extending generally arcuate ridge extending thereacross with the arcuate ridges on adjacent rigid strips overlapping and cooperating with one another to form a substantially continuous upwardly extending reinforcing ridge along the rigid portion of the instep protector.

Another object of the invention is to provide such a reinforced instep protector in which the upwardly extending arcuated ridges are shaped to cooperate with one another to permit substantially free articulation of the reinforcing elements during normal use of the apparatus.

Another object is to provide an improved instep protector of the general type disclosed in U.S. Pat. No. 3,102,347, the disclosure of which is incorporated herein by reference.

BRIEF DESCRIPTION OF THE DRAWINGS

Other objects and advantages of the present invention will become apparent from a consideration of the following description, taken in conjunction with the accompanying drawings, in which:

FIG. 1 is a perspective view of a work type shoe embodying an instep guard according to one embodiment of the present invention;

FIG. 2 is a view similar to FIG. 1 and showing a modified form of the invention;

FIG. 3 is a sectional view taken on line 3—3 of FIG. 1 and showing the instep guard elements of that Figure;

FIG. 4 is a perspective view of the articulated reinforcing structural assembly of the instep guard embodied in FIG. 2;

FIG. 5 is a view similar to FIG. 4 and showing the articulated structure of the embodiment of FIG. 1;

FIG. 6 is a perspective view, from one angle, of one of the individual reinforcing strips of the articulated assembly;

FIG. 7 is a view similar to FIG. 6 but showing the reinforcing strip from a different angle;

FIG. 8 is a plan view of the strip shown in FIGS. 6 and 7;

FIG. 9 is a front elevation view of the reinforcing strip of FIG. 6;

FIG. 10 is a sectional view taken on line 10—10 of FIG. 3;

FIG. 11 is a diagrammatic cross-sectional view taken on line 11—11 of FIG. 10 and showing the strips comprising the articulated protective assembly in their natural or normal rest position;

FIG. 12 is a view similar to FIG. 11 but showing the articulated assembly spread out flat with the strips in the abnormal position relative to each other; and FIG. 13 is a view similar to FIGS. 11 and 12, and showing the articulated assembly in its most arcuate position as when a blow is delivered to the instep guard in use.

DESCRIPTION OF THE PREFERRED EMBODIMENTS

Referring now to the drawings in detail, a safety shoe of the high top or work type embodying a first species of the invention is illustrated in FIG. 1 and designated generally by the reference numeral 10. The safety shoe 10 includes the usual sole 12 and upper 14, and an instep guard according to the present invention, indicated generally at 16, is applied to the shoe over the instep portion thereof with the toe portion 18 of the shoe, preferably incorporating a rigid toe cap, not shown, projecting outward from beneath the forward edge of the guard. The guard 16 has downwardly depending side edge portions that are permanently secured directly to the sole 12 of the shoe in the area between the shank and toe by suitable means such as sewing directly through the sole, leaving the upper portion of the guard free to be flexed forward to enable putting the shoe on a persons foot.

As illustrated in FIG. 3, the guard 16 includes an outer leather envelope or cover 22 which is separated by a dividing sheet 24 of suitable material such as a durable fabric or leather into two compartments, the outer of which encases an articulated rigid plate assembly 26 which constitutes the principal protective armor of the guard, and the lower of which contains a resilient pad 28 of a soft material such as foamed rubber or synthetic resin material. The envelope is closed round its periphery by stitching 30.

The embodiment of the invention shown in FIG. 2 differs from that of FIG. 1 principally in that the instep guard of the FIG. 2 embodiment is constructed as an integral part of the shoe whereas the instep guard of FIG. 1 is constructed separately and attached to a substantially conventional safety toe shoe. Thus, the safety shoe 32 of FIG. 2 includes a tongue 34 within which is located a modified form of the articulated assembly 36 which constitutes the armored instep guard of this embodiment. The leather tongue 34 corresponds to the envelope 22 of the embodiment of FIGS. 1 and 3, and incorporates a divider sheet and resilient pad, not shown, corresponding to that described above with reference to FIG. 3. The flexibility of the articulated assembly 36 permits flexing of the tongue 34 to permit a person wearing the shoe to easily insert or remove his foot and to comfortably walk in the shoe when it is laced up. Throughout the drawings, corresponding parts of the embodiment of FIGS. 1 and 2 are designated by the same reference numerals, with the reference numerals of the FIG. 2 embodiment being primed in FIGS. 2 and 5. In FIGS. 6–13, no distinction is made between parts employed in the two embodiments.

As previously indicated, the articulated rigid strip assemblies constitute the principal armor of the various embodiments of the invention. Further, the various articulated assemblies have a number of common features which will be initially described with reference to FIGS. 6–13, and the unique feature of the respective embodiments will thereafter be described with particular reference to FIGS. 3–5. Thus, the articulated assemblies 24 and 36 each comprise a plurality of elongated, generally arcuate, rigid upper strip members 38 at their upper end, an elongated, generally arcuate rigid intermediate strip member 40 and an elongated generally arcuate rigid lower strip member 42, with intermediate members 40 being substantially wider than upper strip members 38.

Each of the strips 38, 40 and 42 are constructed of a high strength rigid material such as metal or plastic, steel being the preferred material. Also, each strip includes an upwardly offset portion 44 and a downwardly offset portion 46, with portions 44 and 46 running substantially the full length of the strips and being joined by a smooth transition shoulder 48 running in substantially the full length of the strips. The shoulder 48 may be less pronounced, or even completely eliminated, if desired, in bottom strip 42.

The upwardly and downwardly offset portions 44, 46, respectively, are slightly inclined with respect to one another so that, when the strips are joined together in the manner described below, the assembly tends to curve upwardly from bottom to top to generally conform to the contour of the top instep portion of a human foot. Upper strips 38 and intermediate strip 40 are of compound curvature, each having its central portion formed in an upwardly extending arch or ridge 50 extending across its full width from the side edge 52 of upwardly offset portion 44 to side edge 54 of downwardly offset portion 46. The upwardly and downwardly offset relation of portions 44, 46 is carried through the upwardly projecting generally arcuate ridge so that portion 56 projects upwardly above portion 58, with transition shoulder 48 being contoured to form a smooth continuous juncture between the two portions of ridge 50. The radius of curvature of upwardly offset ridge portion 56 is slightly greater than the radius of curvature of ridge portion 58, with the difference in the radius of curvature of the two ridge portions preferably being at least equal to or slightly greater than the thickness of the rigid material from which the individual strips are formed, the purpose of this difference in radius of curvature being more fully explained below.

Each of the strips 38 and 40 are provided with four holes 60 passing therethrough, one located adjacent each corner of the strip, and each lower end strip 42 is provided with two such holes located one adjacent each corner of the downwardly offset portion 46 thereof. The strips 38, 40 and 42 making up each articulated assembly are joined in edgewise overlapping relation by rivets 62 passing through the aligned openings 60 of the overlapping strip edges with the rivets 62 being headed in a manner to permit limited articulation of the respective joined strips to provide the articulated assemblies shown in FIGS. 4 and 5.

The articulated assembly 36 shown in FIG. 5 employs an articulated assembly similar to that illustrated in FIG. 4 and like reference numerals have been used to designate like parts in the two figures, with the reference numerals in FIG. 5 being primed. In the embodiment of FIG. 5, a rigid toe cap member 64 is connected to the upwardly offset edge portion 44′ of lower end strip 42′ by rivets 66 which are headed in a manner to eliminate substantially all articulation between the two members to thereby provide a substantially rigid joint between the strip 42 and toe cap 64. The articulated assembly 36, including the rigid toe cap 64, is incorporated directly into the structure of the shoe.

As shown in FIG. 4, the lower end strip 42 employed in the articulated assembly 24 is preferably substantially longer than the lower end strip 42′ employed in the articulated assembly of FIG. 5, the longer strip 42 having its ends 68 terminating at a position to bear against the sole 12 of shoe 10 to transmit load directly to the sole of the shoe in the event of an impact to the instep guard. Also, the instep guard 16 is attached to the shoe at a location in which at least a portion of the lower end strip overlies the usual rigid toe cap incorporated in the toe portion of the shoe, whereby loads applied to the lower portion of the instep protector are in part transmitted to the toe cap and in part directly to the side of the shoe through the end edges 68 of lower strip 42'.

The rigid strips are connected in the articulated assemblies with the upwardly offset portion of the individual strips overlaying the downwardly offset portion of the strip located lower, i.e., toward the wearer's toes, in the assembly. Since the upwardly projecting arch portions of the individual strips have a relatively short radius of curvature to produce a pronounced upwardly projecting ridge, articulation of the strips is facilitated by the upwardly offset portion 56 having a slightly greater radius of curvature than the downwardly offset portion 58. Thus, the downwardly offset portion can fit in closely spaced relation to an overlying upwardly offset portion so that the arch or ridge sections of the various rigid strips cooperate, in the articulated assembly, to form a substantially continuous strengthening rib along the top of the instep guard. The elevational view of an individual strip 38, shown in FIG. 9, clearly illustrates the differences in curvature of the upwardly and downwardly offset portions throughout the length of the strip. The sectional view of the instep assembly shown in FIG. 10 also clearly shows the substantially uniform spacing of the adjacent strips in the overlapping portion of the articulated assembly when the assembly is in the normal, relaxed position.

The sectional view of the articulated assemblies shown in FIGS. 11–13 illustrates the relative position of adjacent rigid strips under various conditions of loading. In FIG. 11, the strips are shown in the relaxed condition which they normally assume during wearing of a shoe incorporating the instep guard. In FIG. 12 the strips are shown in the condition assumed when a downward load is applied near the top of the instep guard, tending to straighten out the normal curvature of the guard and causing the overlapping portions of the adjacent strips to be moved into firm, surface-to-surface contact with one another to effectively lock the assembly into a single rigid structure and resist further downward movement of the top portion of the assembly. FIG. 13 shows the relative positions of the individual rigid strips when an impact load is applied intermediate the ends of the instep guard, causing it to tend to bend in a direction increasing the curvature. In this condition, the side edge 52 of the overlapping upwardly offset portion of the strips comes into contact with the transition shoulder 48 of the adjacent strip to again effectively lock the assembly into a rigid substantially continuous load bearing member. The natural resilience of the human foot, coupled with the resilience of the padding and envelope portions of the instep guard, permit the articulated assembly to assume this rigidly locked position before the instep guard is deflected downwardly to an extent to be likely to cause substantial injury to the foot. Thereafter, the substantially rigid structure transmits excess load over a wider area, substantially reducing the likelihood of any injury.

The load carrying ability of the instep guard according to the present invention which incorporates the strengthening rib along the top of the guard produced by the overlapping ridge sections enables a substantial strengthening of the articulated assembly without requiring excessive weight increase of the structural portions of the assembly. Tests conducted on safety shoes incorporating the instep guard according to the present invention clearly illustrates that increased protection is provided over that obtained by the articulated assembly employed in the prior art safety shoe and instep guard described above. In the rigid position of the assembly assumed under load, the arch portions cooperate to form an effective strengthening rib extending the full length of the guard.

In addition to the increased protection provided by the strengthening rib, a further measure of protection is obtained by providing a substantially wider intermediate strip 40 which overlies the lower portion of the instep. This wider strip 40 has the effect of eliminating one line of articulation in an area which is highly vulnerable to injury. This permits a greater portion of a load applied in this area to be transmitted directly to the rigid toe cap 64, through the rigidly attached strip 42', in the embodiment of FIG. 2, or through the end strip 42 to the soles of the shoe and the underlying rigid toe cap of the embodiment of FIG. 2. If desired, the lower end strip 42' can be welded directly to the rigid toe cap 64 at the top thereof to further strengthen this portion of the guard in the embodiment of FIG. 2.

In the embodiment of FIG. 2, the strip 42' is preferably attached to toe cap 64 so as to be inclined upwardly at a slight angle along the top of the articulated assembly to provide for freedom of movement and permit more flexing of the sole of the shoe. Attaching strip 42 at this angle is facilitated by removing a part of the upwardly offset portion 44, as illustrated in broken lines in FIG. 8, to permit the strip 42' to be tilted slightly and maintain contact with the top surface of cap 64. The rigidly attached strip 42 also has the advantage of strengthening the rigid toe cap 64 to provide additional protection for the toes.

While I have disclosed and described preferred embodiments of my invention, I wish it understood that I do not intend to be restricted solely thereto, but rather that I do intend to include all embodiments thereof which would be apparent to one skilled in the art and which come within the spirit and scope of my invention.

I claim:

1. In a safety shoe having an instep guard of compound curvature conforming generally to the shape of the human instep and secured to the shoe adjacent at least the lower end of the guard, the guard extending upwardly from the region of the toes of a person wearing the shoe and including a plurality of elongated, generally arch-shaped rigid strips extending transversely of the guard and of the instep of a person wearing the shoe, rivet means articulately interconnecting the plurality of rigid strips in generally side by side relation with their adjacent longitudinal side edges overlapping one another, the improvement comprising, an upwardly extending, generally arcuate arch formed in each said rigid strip and extending transversely thereof, the arcuate arches of adjacent rigid strips overlapping and cooperating to form a continuous upwardly projecting reinforcing ridge throughout substantially the full length of said instep guard.

2. The safety shoe according to claim 1 wherein a plurality of the rigid strips including at least each of the rigid strips intermediate the ends of said guard are formed with portions along each longitudinal edge which are offset upwardly and downwardly, respectively, relative to one another with the upwardly and downwardly offset portions being joined by a central transition portion, the offset portions extending substantially the full length of the rigid strips, said upwardly offset portion of the rigid strips overlying the downwardly offset portion of the adjacent strips in the assembly.

3. The safety shoe according to claim 2 wherein the radius of curvature of the portion of the generally arcuate arch extending transversely of the upwardly offset portion of said strips is greater than the radius of curvature of the portion extending transversely of the downwardly offset portion.

4. The safety shoe according to claim 1 wherein said guard comprises a plurality of rigid strips which are of substantially the same width, measured longitudinally of the guard, and one said rigid strip which is of substantially greater width, the one strip of greater width being located near the lower end of the guard.

5. The safety shoe according to claim 4 wherein a plurality of the rigid strips including at least each of the rigid strips intermediate the ends of said guard are formed with portions along each longitudinal edge which are offset upwardly and downwardly, respectively, relative to one another with the upwardly and downwardly offset portions being joined by a central transition portion, the offset portions extending substantially the full length of the rigid strips, said upwardly offset portion of the rigid strips overlying the downwardly offset portion of the adjacent strips in the assembly.

6. The safety shoe according to claim 5 wherein the radius of curvature of the portion of the generally arcuate arch extending transversely of the upwardly offset portion of said strips is greater than the radius of curvature of the portion extending transversely of the downwardly offset portion.

7. The safety shoe according to claim 4 further comprising a rigid toe cap member, the rigid strip at the lower end of the guard overlying the rear edge portion of the toe cap member and being fixidly mounted thereon.

8. The safety shoe according to claim 4 wherein said one strip of substantially greater width is articulately mounted on the lower end strip.

9. The safety shoe according to claim 7 wherein a plurality of the rigid strips including at least each of the rigid strips intermediate the ends of said guard are formed with portions along each longitudinal edge which are offset upwardly and downwardly, respectively, relative to one another with the upwardly and downwardly offset portions being joined by a central transition portion, the offset portions extending substantially the full length of the rigid strips, said upwardly offset portion of the rigid strips overlying the downwardly offset portion of the adjacent strips in the assembly.

10. The safety shoe according to claim 9 wherein said rigid toe cap member and said articulated assembly are constructed as integral parts of said safety shoe, said instep guard extending upwardly over the instep portion of a wearer's foot and serving as the tongue of the shoe.

* * * * *